US010156065B2

(12) United States Patent
Vanker et al.

(10) Patent No.: US 10,156,065 B2
(45) Date of Patent: Dec. 18, 2018

(54) STAIR INSTALLATION BRACKET

(71) Applicant: PatCo LLC, Arvada, CO (US)

(72) Inventors: John Louis Vanker, Denver, CO (US); Michael J. Lastowski, Centennial, CO (US)

(73) Assignee: PATCO, LLC, Arvada, CO (US)

( * ) Notice: Subject to any disclaimer, the term of this patent is extended or adjusted under 35 U.S.C. 154(b) by 0 days.

(21) Appl. No.: 15/407,999

(22) Filed: Jan. 17, 2017

(65) Prior Publication Data

US 2018/0202143 A1 Jul. 19, 2018

(51) Int. Cl.

| | |
|---|---|
| ***B23P 19/04*** | (2006.01) |
| ***E04B 1/41*** | (2006.01) |
| ***E04F 11/022*** | (2006.01) |
| *E04B 1/38* | (2006.01) |

(52) U.S. Cl.

CPC ..... *E04B 1/40* (2013.01); *E04F 11/022* (2013.01); *E04B 2001/405* (2013.01)

(58) Field of Classification Search

CPC ..... B23P 19/066; B23Q 1/0072; B23Q 1/03; B23Q 1/28; B23Q 1/52; B23Q 3/06

See application file for complete search history.

(56) References Cited

U.S. PATENT DOCUMENTS

| | | | | |
|---|---|---|---|---|
| 5,584,462 | A | 12/1996 | Reese | |
| 5,921,535 | A * | 7/1999 | Lutz, III | B25B 5/12 269/228 |
| 6,062,541 | A * | 5/2000 | Hampton | B23Q 1/0063 248/651 |
| 8,827,255 | B2 * | 9/2014 | Woods | B25B 5/163 269/120 |
| 2006/0049567 | A1 * | 3/2006 | Nishimura | B25B 5/10 269/228 |
| 2008/0135701 | A1 | 6/2008 | Smith | |
| 2009/0212271 | A1 | 8/2009 | Platt | |
| 2015/0084258 | A1 * | 3/2015 | Gosinski | B25B 5/04 269/238 |

FOREIGN PATENT DOCUMENTS

| | | |
|---|---|---|
| KR | 10-2007-0009265 A | 1/2007 |
| KR | 10-2012-0000245 A | 1/2012 |

OTHER PUBLICATIONS

International Search Report and Written Opinion, Korean Intellectual Property Office, dated Apr. 26, 2018.

* cited by examiner

*Primary Examiner* — Lee D Wilson
(74) *Attorney, Agent, or Firm* — Holzer Patel Drennan

(57) ABSTRACT

In one implementation, a stair installation bracket for installing staircases in stairwells is provided. The bracket includes a bracket assembly configured to anchor to a wall of a stairwell, a hanger tool removably connected to the bracket assembly, and a positioning bolt for positioning a staircase relative to the wall. A method of installing a staircase using the bracket assembly includes positioning the staircase on tabs of one or more bracket assemblies, rotating the positioning bolt to vertically positioning the staircase relative to pilot holes of the bracket assembly, anchoring the staircase to the bracket assembly, and removing the hanger tool from the bracket assembly.

18 Claims, 8 Drawing Sheets

STAIR INSTALLATION BRACKET

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Other features, details, utilities, and advantages of the claimed subject matter will be apparent from the following more particular written Detailed Description of various implementations and implementations as further illustrated in the accompanying drawings and defined in the appended claims Implementations described herein provide a stair installation bracket for installing staircases in stairwells. The bracket includes a bracket assembly configured to anchor to a wall of a stairwell, a hanger tool removably connected to the bracket assembly, and a positioning bolt for positioning a staircase relative to the wall.

BRIEF DESCRIPTIONS OF THE DRAWINGS

A further understanding of the nature and advantages of the present technology may be realized by reference to the figures, which are described in the remaining portion of the specification. In the figures, like reference numerals are used throughout several figures to refer to similar components. In some instances, a reference numeral may have an associated sub-label consisting of a lower-case letter to denote one of multiple similar components. When reference is made to a reference numeral without specification of a sub-label, the reference is intended to refer to all such multiple similar components.

DETAILED DESCRIPTIONS

In designing and engineering a building's structure, many different assemblies (walls, columns, beams, bracing, strapping, and the fasteners that fasten them together) may be needed to form the building's structure and to manage loads and forces. The assemblies may be standardized through a limited number of uniquely designed standardized wall panels, trusses, fasteners, and other framing components, which may be manufactured using an automated technique such as by roll forming steel sheets. This unique and standardized assembly of elements may be used to form the building's structure and may effectively support loads and forces. Furthermore, these standardized assemblies may be useful in reducing the cost and time in designing such buildings. In multi-story residential or commercial buildings, standardized stairwells may be formed by these standardized components. As such, standardized staircases may be configured to fit in the standardized stairwells. The staircases may be pre-fabricated before the staircases are installed in the building. The pre-fabricated staircases may be anchored to the stairwell wall using fasteners. However, installation of a pre-fabricated staircase may be difficult due to the size and shape of the staircase. For example, a crane may be used to lower the staircase into the stairwell where the staircase must be anchored to specific areas of the stairwell walls. A crane is not effective in positioning a large and heavy staircase to a specific location in the stairwell.

In the implementations described herein, a bracket system is provided that allows a staircase to be roughly positioned relative to specific anchor point in a stairwell. The bracket provides a hanger tool with positioning bolts that may be used to accurately position the staircase relative to the specific anchor points. Once the staircase is accurately positioned, the staircase is anchored to the stairwell wall using the bracket and pre-installed bolts, and the hanger tool with the positioning bolt may be removed. These implementations are described further with respect to the following figures.

Figure 1:
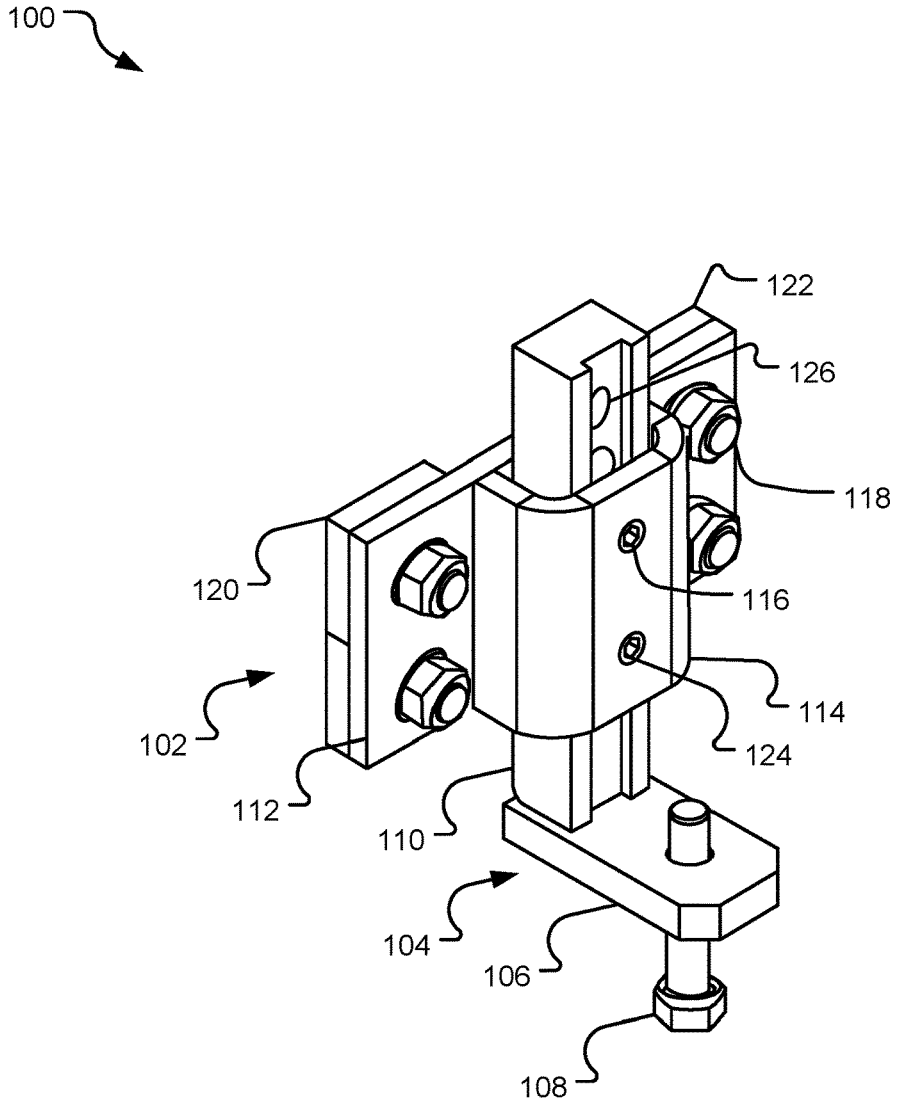
FIG. 1 illustrates a view of an example stair installation bracket.

FIG. 1 illustrates a view of an example stair installation bracket 100. The stair installation bracket 100 includes a bracket assembly 102 and a hanger tool 104. The bracket assembly 102 includes back plates 120 and 122, a front plate 112 and a channel assembly 114. The back plates 120 and 122 provide spacing between the bracket 102 and a stairwell wall (not shown). The channel assembly 114 may be welded or otherwise connected to the front plate 112 and is formed to have an opening through which a hanger tool 104 may fit. The bracket assembly 102 including the back plates 120 and 122 and the front plate 112 with the channel assembly 114 may be anchored to the stairwell wall with fasteners (e.g., a bolt 118). As such the front plate 112 and the back plates 120 and 122 may have pre-formed pilot holes to receive the fastener bolts. In implementations the fasteners may be epoxy anchoring bolts such as to anchor the bracket 100 to a concrete wall. The channel assembly 114 includes one or more pre-formed pilot-holes (e.g., pilot hole 124) through which headless bolts (e.g., headless bolt 116) may fit.

The hanger tool 104 includes a vertical column 110, a lower tab 106, and a positioning bolt 108. The hanger tool 104 may be formed of one piece of metal or otherwise welded together. The vertical column 110 of the hanger tool 104 may be configured to fit in the channel of the channel assembly 114 of the bracket assembly 102. The vertical column 110 includes one or more pre-formed pilot holes (e.g., pilot hole 126) configured to receive an end of headless bolts that fit through the channel assembly 114. For example, the headless bolt 116 fits into a pilot hole of the vertical column 110. The headless bolts (e.g., headless bolt 116) may be threaded and as such, the pilot holes of the channel assembly 114 and the vertical column are threaded to receive the headless bolts. The headless bolts fit into the vertical column 110 such as to hold the hanger tool 104 in place. The positioning bolt 108 is a threaded bolt that fits into a pilot hole of the tab 106. The positioning bolt 108 moves vertically depending on a direction of rotation.

One or more of the stair installation brackets 100 may be installed on a stairwell wall and configured to receive a landing of a pre-fabricated staircase (not shown). An edge wall of the staircase may be positioned to rest on the tab 106 of the stair installation bracket 100. As such, the hanger tool 104 may support the staircase until the staircase is attached directly to the bracket assembly 102. When resting on the tab 106, the positioning bolt 108 may be rotated causing the bolt to move up or down, until the staircase is positioned into a desired location relative to the bracket assembly 102. A sidewall of the staircase may include pre-formed pilot holes, and as such, the pilot holes must be aligned with the pilot holes of the channel assembly 114. Thus, the positioning bolt 108 is rotated until the pilot holes of the staircase wall are aligned with the pilot holes of the channel assembly 114. Once the pilot holes of the staircase wall are aligned with the pilot holes of the channel assembly 114, the headless bolts may be rotated such as to engage the headless bolts with the pilot holes of the stairwell wall. As a result, the stairwell is anchored to the bracket assembly 102. Furthermore, the headless bolts disengage with the pilot holes of the hanger tool 104. As such, the headless bolts may contemporaneously engage with the staircase and disengage with the hanger tool 104.

Figure 2:
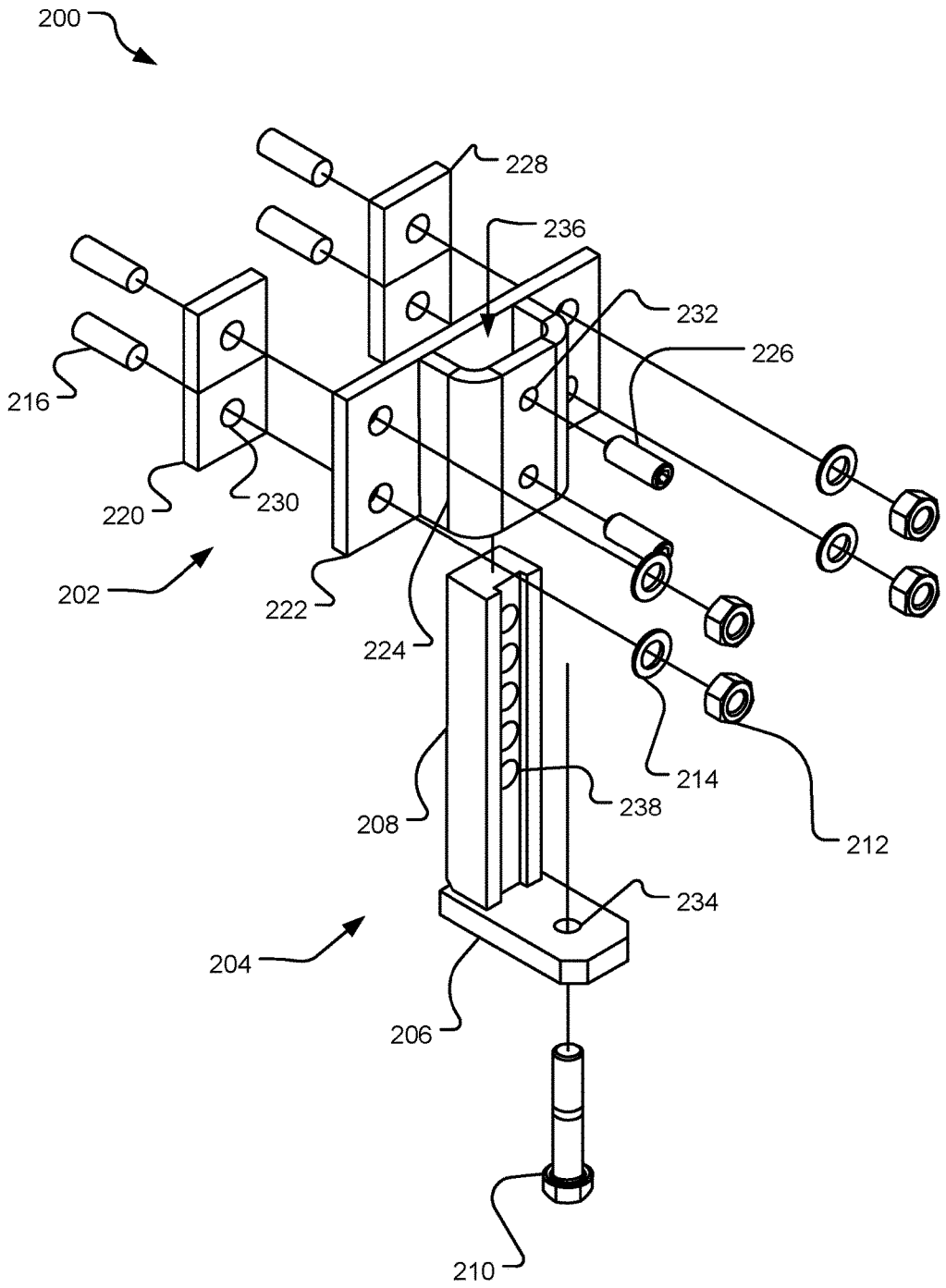
FIG. 2 illustrates an exploded view of an example stair installation bracket.

FIG. 2 illustrates an exploded view of an example stair installation bracket 200. The bracket 200 includes a bracket assembly 202 and a hanger tool 204. The bracket assembly 202 includes back plates 220 and 228, a front plate 222 with a channel assembly 224. The back plates 220 and 228 and front plate 222 include pre-formed pilot holes (e.g., a pilot hole 230) configured to receive fasteners (e.g., a fastener 216). In the illustrated implementation, the fasteners are bolts with nuts and washers (e.g., a nut 212 and washer 214) utilized to anchor the bracket assembly 202 to a wall of a stairwell (not shown). The bolts may be anchored to the wall (e.g., a concrete wall) with epoxy anchoring bolts. The channel assembly 224 of the bracket assembly 202 may be welded or otherwise connected to the front plate 222 and includes one or more pre-formed pilot holes (e.g., pilot hole 232) for receiving headless bolts (e.g., headless bolt 226).

The hanger tool 204 includes a vertical column 208, a tab 206 with a pilot hole 234 configured to receive a positioning bolt 210. The vertical column is configured to fit into a channel 236 formed by the channel assembly 224 of the bracket assembly 202. The vertical column further includes one or more pilot holes (e.g., a pilot hole 238) configured to receive and engage with the headless bolts (e.g., the headless bolt 226). When the headless bolts are positioning in the channel assembly 224 of the bracket assembly 202 and in one of the pilot holes of the vertical column 208, the hanger tool 204 is anchored in place.

When the hanger tool 204 is anchored to the bracket assembly 202, a staircase landing (not shown) may be positioned on the tab 206 of the hanger tool. The positioning bolt 210 may be rotated until a pilot hole of the staircase landing (not shown) is aligned with the pilot holes of the channel assembly 224. Once alignment is achieved, the headless bolts (e.g., the headless bolt 226) may be rotated such as to anchor the staircase to the bracket assembly 202 of the stair installation bracket). Nuts and bolts may be used to further anchor the staircase to the bracket assembly 202. Furthermore, as the headless bolts are rotated, the bolts move outward and release the hanger tool 204. As such, the hanger tool 204 may be removed from the bracket assembly 202.

Figure 3:
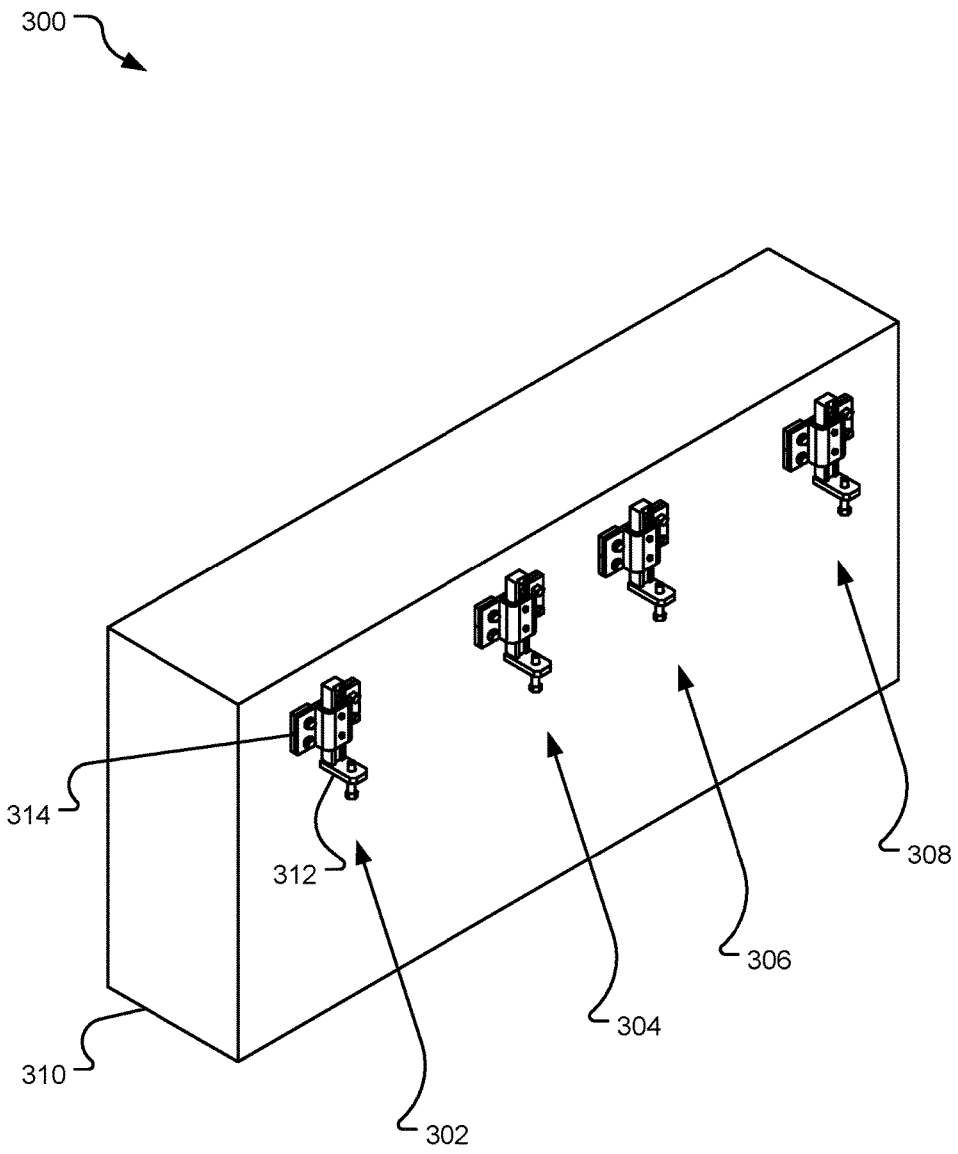
FIG. 3 illustrates a view of example stair installation brackets installed on a wall.

FIG. 3 illustrates a view 300 of example stair installation brackets 302-308 installed on a stairwell wall 310. A prefabricated staircase (not shown) may be positioned on the tabs (e.g., tab 312 of the stair installation bracket 302) of the stairwell installation brackets until the staircase is anchored to a bracket assembly (e.g., bracket assembly 314 of the stair installation bracket 302) of the stairwell installation brackets. In some implementations, a first staircase may be anchored to stair installation brackets 302 and 304, and a second staircase may be anchored to stair installation brackets 306 and 308. As such, a top landing of the first staircase may be anchored to brackets 302 and 304 and a bottom landing of the second staircase may be anchored to brackets 306 and 308. Once the one or more staircases are anchored to the stair installation brackets, the hanger tools of the brackets may be removed (e.g., hanger tool 312 may be removed from stair installation bracket 302).

Figure 4:
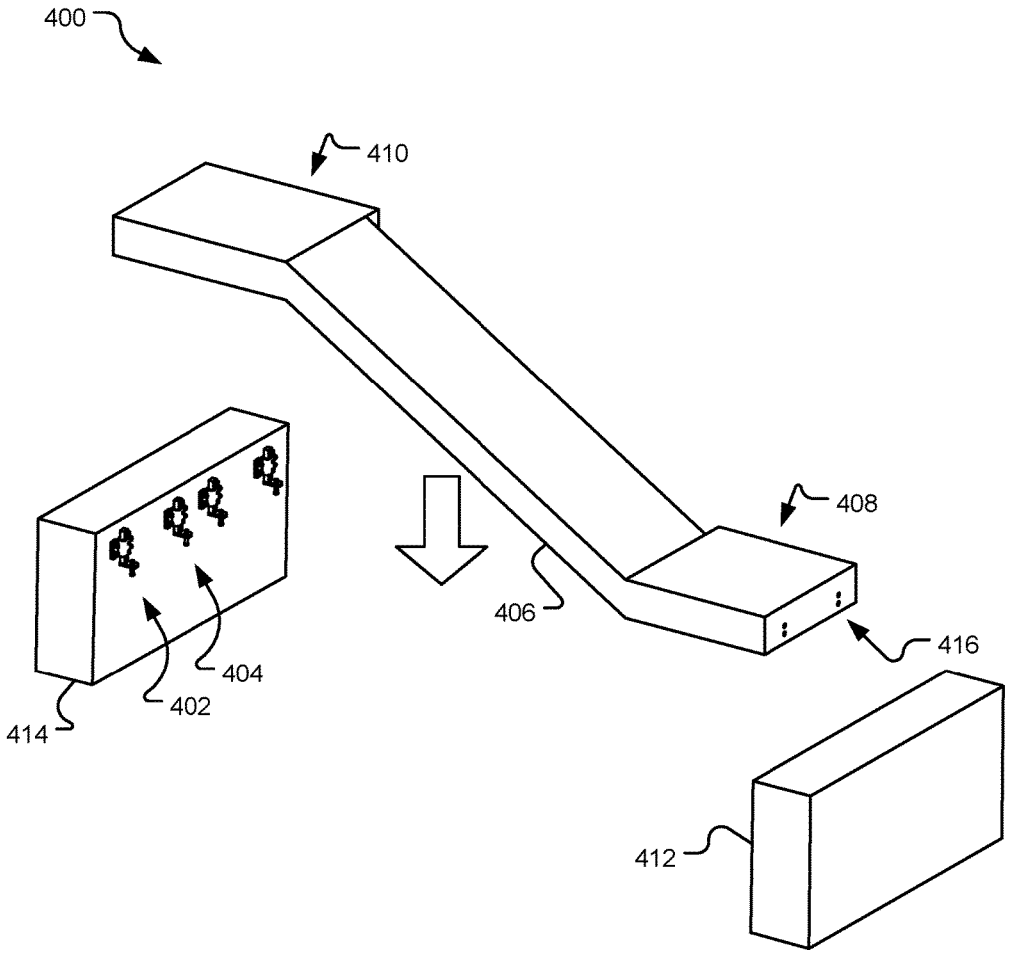
FIG. 4 illustrates a view of installation of a staircase between walls using example stair installation brackets.

FIG. 4 illustrates a view 400 of installation of a staircase 406 between walls 412 and 414 using example stair installation brackets 402 and 404. The staircase 406 includes a top landing 410 and a bottom landing 408. The staircase 406 may be pre-fabricated to fit into a stairwell formed by walls (e.g., walls 412 and 414) and may be lowered into position by a crane, by hand, etc. The staircase 406 may include pre-formed pilot holes (e.g., pilot holes 416) such as to anchor the staircase 406 to the stair installation brackets. Stair installation brackets 402 and 404 are positioned to receive the top landing 410 of the staircase 406. The staircase 406 may be placed on hanger tools of each stair installation bracket. Once the staircase is positioned on the hanger tools of the respective installation brackets, a positioning bolt on each hanger tool is rotated such as to align the pilot holes of the staircase 406 with the pilot holes of the stair installation bracket. Once aligned, headless bolts are used to anchor the staircase 406 to the stair installation brackets. After the staircase is anchored, the hanger tools of each stair installation bracket may be removed.

Figure 5:
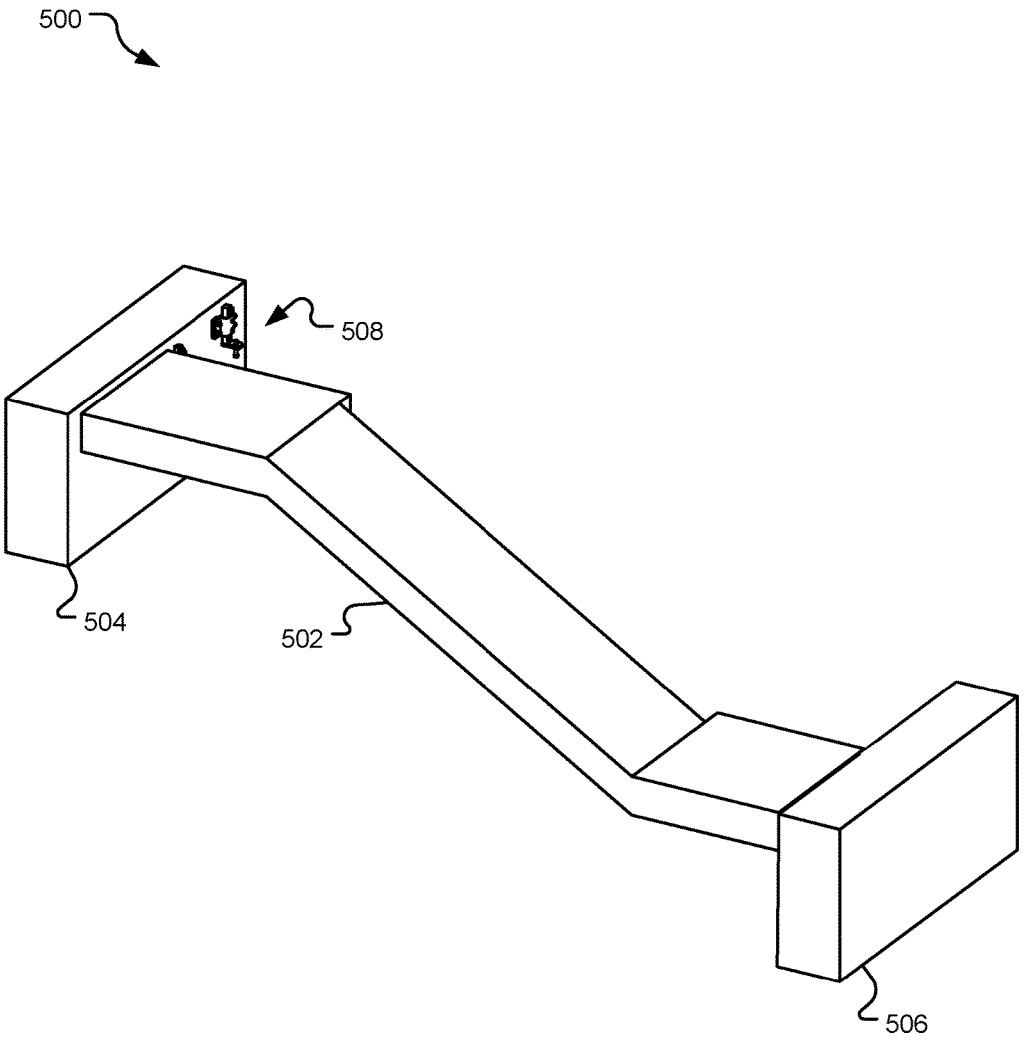
FIG. 5 illustrates a view of a staircase installed between walls using example stair installation brackets.

FIG. 5 illustrates a view 500 of an installed staircase 502. The staircase 502 is installed between walls 504 and 506 using stair installation brackets. Stair installation brackets 508 are positioned to receive another staircase (not shown). For example, a bottom landing of another staircase may be positioned to anchor to the wall 504 using the stair installation brackets 508. The staircase 502 is anchored to walls 504 and 506 using the stair installation brackets disclosed herein. Because the staircase 502 is anchored to the walls via the stair installation brackets, the hanger tools of the stair installation brackets may be removed.

Figure 6:
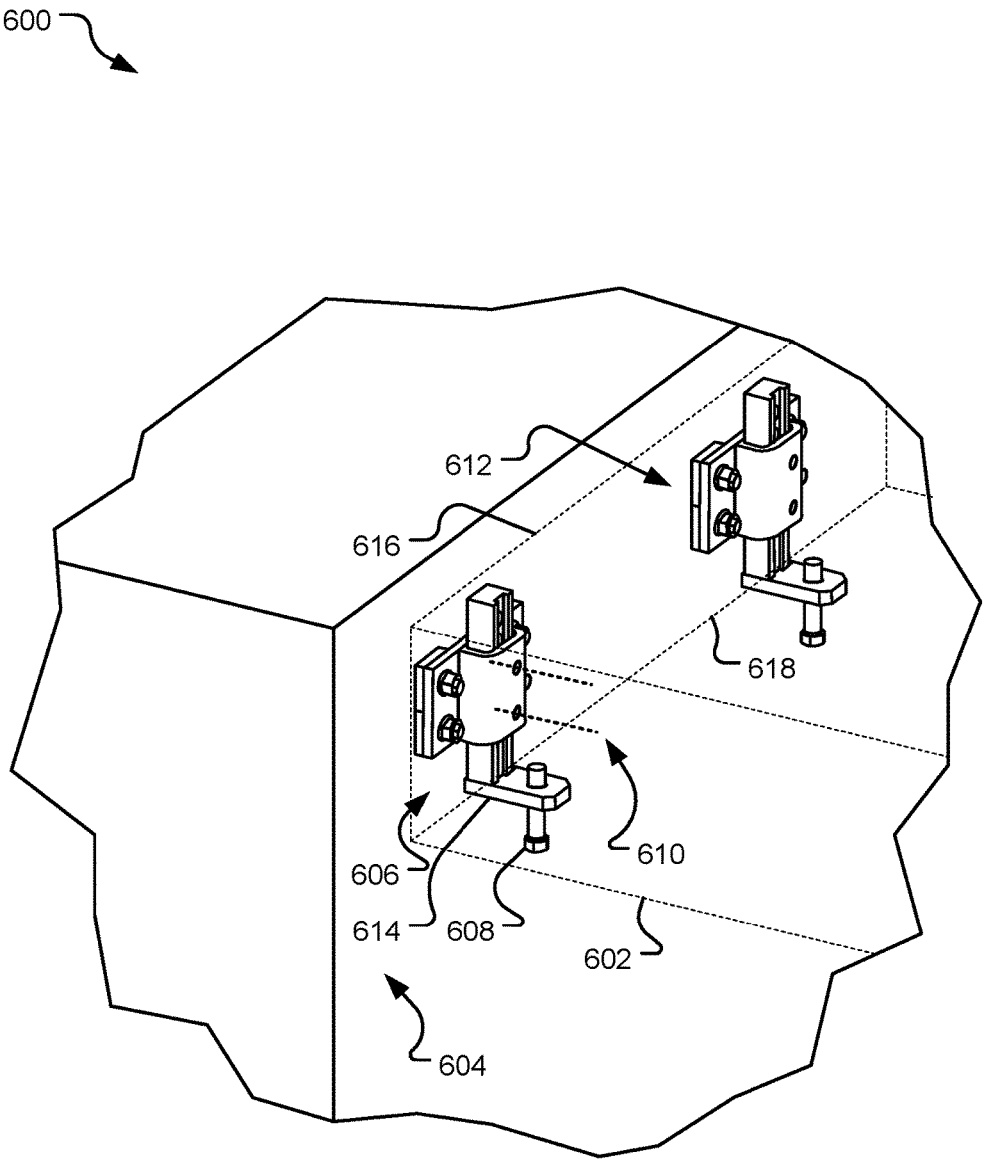
FIG. 6 illustrates an expanded view of a staircase being installed on example stair installation brackets.

FIG. 6 illustrates an expanded view 600 of a staircase being installed on example stair installation brackets 606 and 612. Specifically, FIG. 6 illustrates a landing 602 of a staircase positioned on tabs of hanger tools of the stair installation brackets 606 and 612, which are mounted to a wall 604 of a stairwell. For example, the landing 602 is positioned on a tab 614 of the hanger tool of stair installation bracket 606. The landing 602 includes an end wall (e.g., the wall between lines 616 and 618). The end wall may have pre-formed pilot holes (not shown) for anchoring the staircase. Positioning bolts (e.g., a positioning bolt 608) may be rotated such as to position the landing 602 of the staircase such that the pre-formed pilot holes are aligned with pilot holes of the stair installation bracket (e.g., along lines 610). When the landing 606 is aligned, headless bolts of the stair installation brackets may be rotated such as to engage the headless bolts to the end wall of the stair case. As a result, the landing 602 is anchored to the stair installation brackets. As the headless bolts are rotated to anchor the landing 602, the hanger tools of each stair installation bracket 606 and 612 may be removed.

Figure 7:
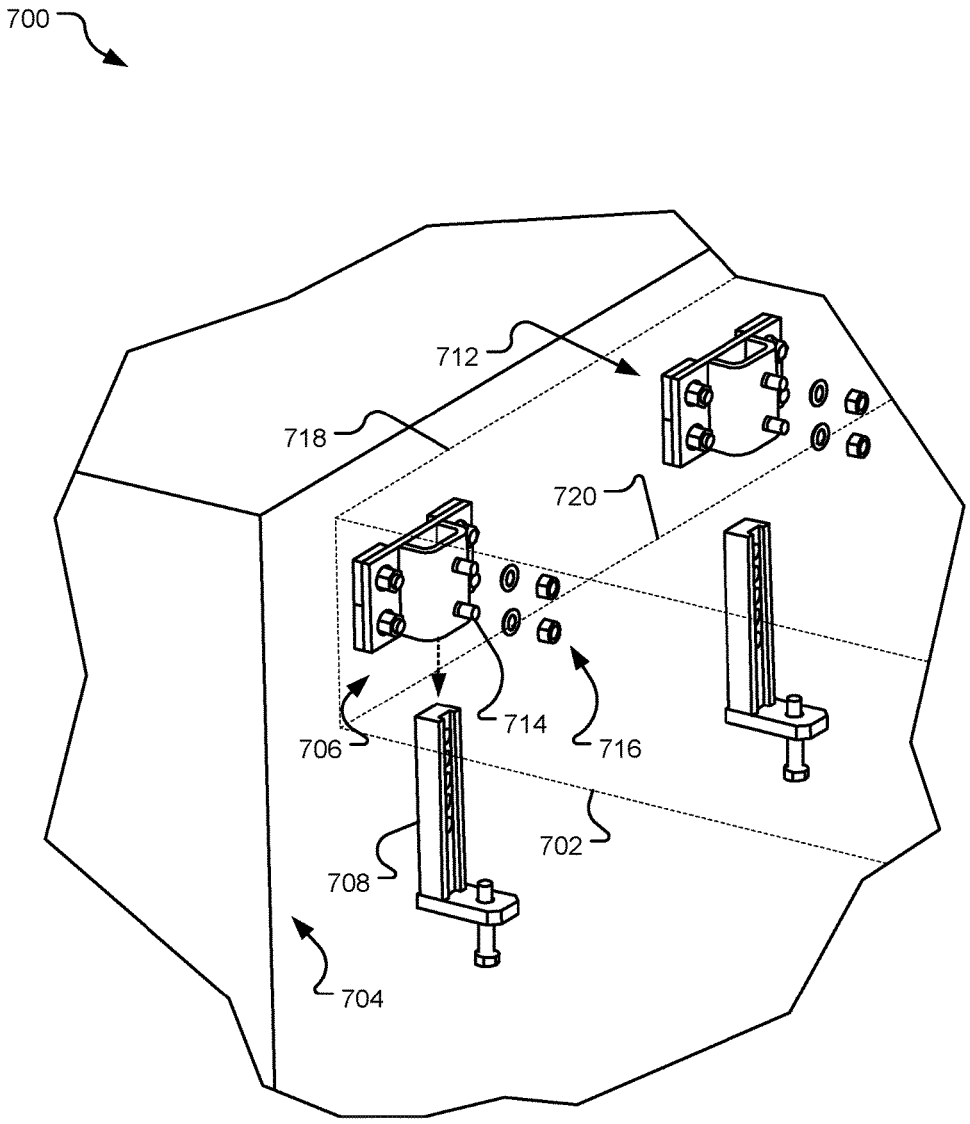
FIG. 7 illustrates another expanded view of a staircase being installed on example stair installation brackets.

FIG. 7 illustrates another expanded view 700 of a staircase being installed on example stair installation brackets 706 and 712. Specifically, FIG. 7 illustrates removal of hanger tools (e.g., hanger tool 708) from the stair installation brackets 706 and 712. Stair installation brackets 706 and 712 are attached to a stairwell wall 704 using fasteners (e.g., fasteners 720 of stair installation bracket 706). In implementations, the fasteners are epoxy anchoring bolts utilized to anchor the stair installation brackets to a concrete wall. Furthermore, headless bolts (e.g., a headless bolt 714) are anchoring a landing 702 of a staircase to a wall 704 of a stairwell. Nuts and bolts 716 are used to firmly attach an end wall (e.g., an end wall formed by lines 718 and 720) to the stair installation brackets 706 and 712.

The stair installation brackets (e.g., stair installation brackets 706 and 712) have been described with respect to installation of staircases. However, it should be understood that the stair installation brackets may be used to install other structures such as flooring, ceilings, platforms, etc.

Figure 8:
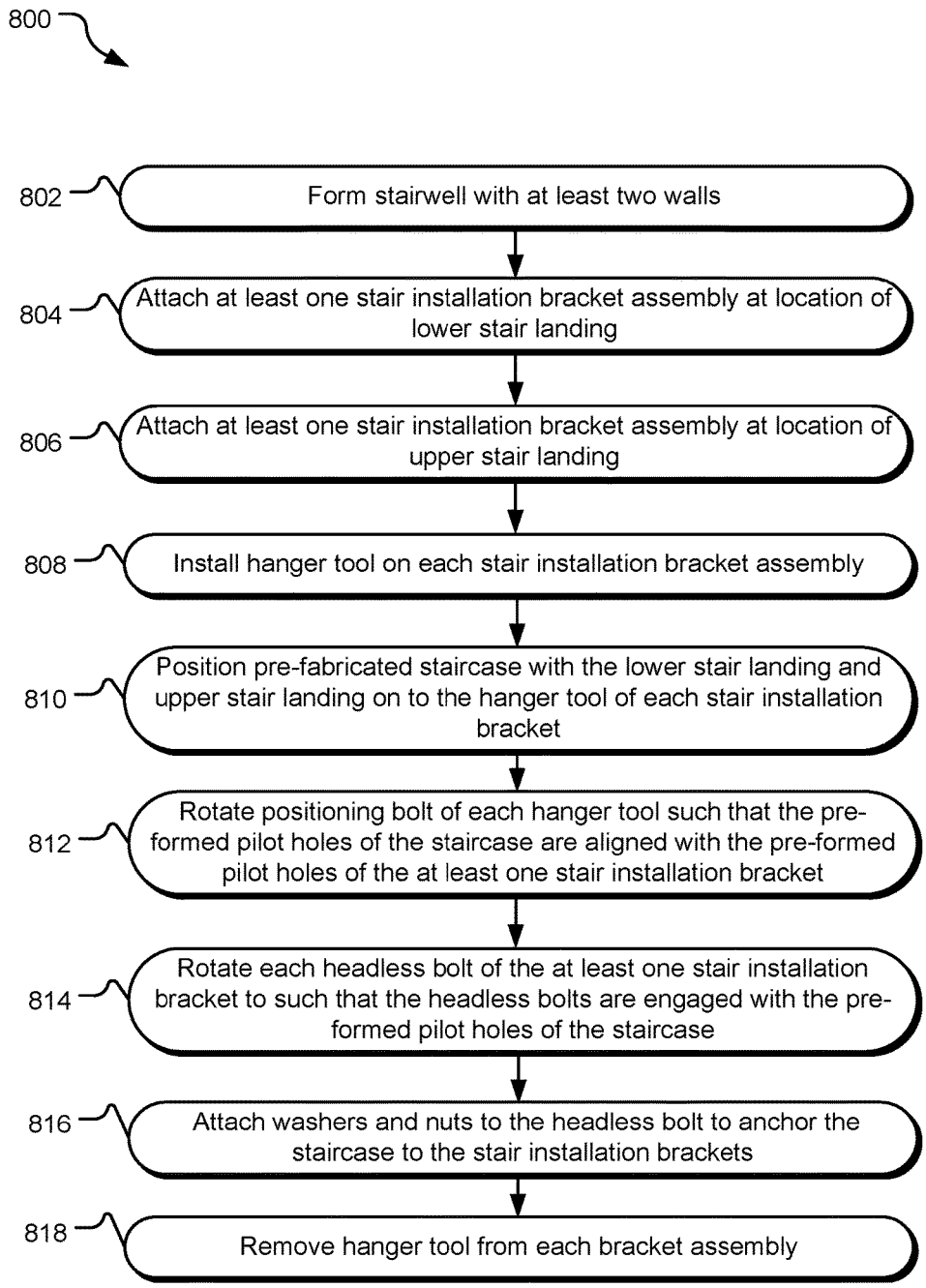
FIG. 8 illustrates example operations for installation of a staircase using the example stair installation brackets.

FIG. 8 illustrates example operations 800 for installation of a staircase using the example stair installation brackets described herein. A forming operation 802 forms a stairwell with at least two walls. The stairwells may be formed of standardized wall panels or formed using concrete. An attaching operation 804 attaches at least one stair installation bracket assembly to the stairwell wall at a location for a lower staircase landing. Another attaching operation 806 attaches at least one stair installation bracket assembly to the stairwell wall at a location for an upper staircase landing. The selected locations of operations 804 and 806 may be based on a standardized size of a staircase. The stair installation brackets may be attached to the stairwell walls using fasteners such as epoxy anchoring bolts (e.g., to attach the brackets to a concrete stairwell wall). An installing operation 808 installs a hanger tool on each stair installation bracket assembly. The operation 808 may include inserting a vertical column of the hanger tool into a channel assembly of the bracket assembly and inserting and tightening a headless bolt into a pre-formed pilot hole in the vertical column. It should be understood that the hanger tools may be installed on the brackets prior to the bracket assemblies being attached to the wall.

A positioning operation 810 positions a pre-fabricated staircase with a lower staircase landing and an upper staircase landing on to the hanger tool of each stair installation bracket. The positioning operation 810 may include lowering the staircase onto the brackets using a crane and/or manpower. Once the staircase is positioned on the brackets such that the upper staircase landing is on the upper landing brackets and the lower staircase landing is on the lower landing brackets, a rotating operation 812 rotates the positioning bolts of the stair installation brackets such that the pre-formed pilot holes of the staircase are aligned with the pre-formed pilot holes of the bracket.

A second rotating operation 814 rotates each headless bolt of the at least one stair installation bracket such that the headless bolts are engaged with the pre-formed pilot holes of the staircase. An attaching operation 816 attaches washers and nuts to the headless bolt to anchor the staircase to the stair installation brackets. A removing operation 818 removes the hanger tool from each bracket assembly.

The above specification, examples, and data provide a complete description of the structure and use of exemplary embodiments of the invention. Since many embodiments of the invention can be made without departing from the spirit and scope of the invention, the invention resides in the claims hereinafter appended. Furthermore, structural features of the different embodiments may be combined in yet another embodiment without departing from the recited claims. Although the present invention has been described with reference to preferred embodiments, workers skilled in the art will recognize that changes may be made in form and detail without departing from the scope of the invention. The implementations described above and other implementations are within the scope of the following claims.

What is claimed is:

1. A bracket comprising:

a bracket assembly configured to be anchored to a wall of a stairwell, the bracket assembly including a channel;

a hanger tool removably connected to the bracket assembly, the hanger tool including a vertical column and a lower tab, the vertical column being configured to fit into the channel of the bracket assembly; and a positioning bolt positioned in the lower tab of the hanger tool, the positioning bolt usable to vertically position a staircase relative to the wall.

2. The bracket of claim 1 wherein the hanger tool is removably connected to the bracket assembly via one or more headless bolts.

3. The bracket of claim 2 wherein the one or more headless bolts are configured to disengage from the hanger tool when rotated.

4. The bracket of claim 2 wherein the one or more headless bolts are configured to engage with the staircase when rotated, thereby anchoring the staircase to the bracket assembly.

5. The bracket of claim 4 further comprising:

a nut for each of the one or more headless bolts, the nut further anchoring the staircase to the bracket assembly.

6. The bracket of claim 1 wherein the hanger tool includes one or more pilot holes arranged along the vertical column, the one or more pilot holes for receiving one or more headless bolts.

7. The bracket assembly of claim 1 wherein the positioning bolt of the hanger tool is inserted through the lower tab of the hanger tool, the lower tab extending from the vertical column of the hanger tool.

8. The bracket of claim 1 wherein the one or more headless bolts are configured to disengage from the hanger tool and engage with a landing of the staircase when rotated.

9. The bracket of claim 8 wherein the bracket assembly supports the landing of the staircase when the one or more headless bolts are rotated to engage with the landing of the staircase.

10. The bracket of claim 8 wherein the hanger tool is removeably connected to the bracket assembly via one or more headless bolts.

11. A bracket assembly comprising:

a front plate including one or more pilot holes for attaching the bracket assembly to a wall via one or more fasteners inserted through the one or more pilot holes of the front plate; and a channel assembly attached to the front plate and including a channel for receiving a hanger tool, the channel assembly including one or more pilot holes for receiving one or more headless bolts for attaching the hanger tool, the hanger tool including a positioning bolt for vertically positioning a landing relative to the wall.

12. The bracket assembly of claim 11 wherein the one or more headless bolts are configured to disengage from the hanger tool when rotated.

13. The bracket assembly of claim 11 wherein the one or more headless bolts are configured to disengage from the hanger tool when rotated.

14. The bracket assembly of claim 11 wherein the hanger tool includes one or more pilot holes arranged along a vertical column, the one or more pilot holes for receiving the one or more headless bolts.

15. The bracket assembly of claim 14 wherein the positioning bolt of the hanger tool is inserted through a lower tab of the hanger tool, the lower tab extending from the vertical column of the hanger tool.

16. The bracket assembly of claim 11 wherein the bracket assembly supports the landing when the one or more headless bolts are rotated to engage with the landing.

17. The bracket assembly of claim 11 wherein the one or more headless bolts are configured to attach the bracket assembly to the landing.

18. The bracket assembly of claim 17 wherein the one or more headless bolts are configured to receive a nut to further secure the landing to the bracket assembly.

* * * * *